US008720485B2

(12) United States Patent
Mason

(10) Patent No.: US 8,720,485 B2
(45) Date of Patent: May 13, 2014

(54) FUEL SYSTEM INCLUDING DUAL FUEL DELIVERY MODULES FOR BIFURCATED FUEL TANKS

(75) Inventor: R. Paul Mason, Dearborn, MI (US)

(73) Assignee: Robert Bosch GmbH, Stuttgart (DE)

( * ) Notice: Subject to any disclaimer, the term of this patent is extended or adjusted under 35 U.S.C. 154(b) by 778 days.

(21) Appl. No.: 12/792,906

(22) Filed: Jun. 3, 2010

(65) Prior Publication Data

US 2011/0297260 A1 Dec. 8, 2011

(51) Int. Cl.
*F04F 5/00* (2006.01)

(52) U.S. Cl.
USPC ..... 137/565.22; 137/265; 123/514

(58) Field of Classification Search
USPC ..... 137/265, 565.22, 565.34; 123/514, 510, 123/511
See application file for complete search history.

(56) References Cited

U.S. PATENT DOCUMENTS

| | | | | |
|---|---|---|---|---|
| 3,884,255 | A | 5/1975 | Merkle | |
| 4,683,864 | A | 8/1987 | Bucci | |
| 4,838,307 | A | 6/1989 | Sasaki et al. | |
| 4,860,714 | A | 8/1989 | Bucci | |
| 5,020,566 | A | 6/1991 | Shoop | |
| 5,078,169 | A | 1/1992 | Scheurenbrand et al. | |
| 5,163,466 | A | 11/1992 | Moody | |
| 5,197,444 | A | 3/1993 | Lang et al. | |
| 5,360,034 | A | 11/1994 | Der Manuelian | |
| 5,450,832 | A | 9/1995 | Graf | |
| 5,623,910 | A * | 4/1997 | Riggle | 123/510 |
| 5,647,328 | A | 7/1997 | Fournier et al. | |
| 5,647,329 | A | 7/1997 | Bucci et al. | |
| 5,732,684 | A | 3/1998 | Thompson | |
| 5,850,851 | A | 12/1998 | Miura et al. | |
| 5,875,816 | A | 3/1999 | Frank et al. | |
| 5,881,698 | A | 3/1999 | Tuckey et al. | |
| 5,896,846 | A | 4/1999 | Bauer et al. | |
| 5,983,932 | A | 11/1999 | Wagner et al. | |
| 6,276,342 | B1 | 8/2001 | Sinz et al. | |
| 6,283,142 | B1 | 9/2001 | Wheeler et al. | |
| 6,371,153 | B1 | 4/2002 | Fischerkeller et al. | |
| 6,457,945 | B2 | 10/2002 | Kleppner et al. | |
| 7,069,913 | B1 * | 7/2006 | Crary | 123/509 |
| 7,234,451 | B2 | 6/2007 | Betz, II et al. | |
| 2004/0237941 | A1 * | 12/2004 | Sinz | 123/509 |
| 2006/0112937 | A1 * | 6/2006 | Tittmann | 123/510 |
| 2008/0095642 | A1 * | 4/2008 | Schelhas et al. | 417/189 |

FOREIGN PATENT DOCUMENTS

| | | |
|---|---|---|
| EP | 0979939 | 2/2000 |

* cited by examiner

*Primary Examiner* — Stephen M Hepperle
*Assistant Examiner* — Angelisa Hicks
(74) *Attorney, Agent, or Firm* — Michael Best & Friedrich LLP

(57) ABSTRACT

A fuel system for use in a fuel tank having first and second tank portions includes first and second fuel pumps in the first and second tank portions, respectively. A first fuel reservoir is provided in the first tank portion and a second fuel reservoir is provided in the second tank portion. A first crossover fuel line extends between the first and second tank portions, and a second crossover fuel line extends between the first and second tank portions. A first jet pump in the first tank portion communicates with the first crossover fuel line for transferring fuel through the first crossover fuel line to the second tank portion, and a second jet pump in the second tank portion communicates with the second crossover fuel line for transferring fuel through the second crossover fuel line to the first tank portion.

19 Claims, 2 Drawing Sheets

FUEL SYSTEM INCLUDING DUAL FUEL DELIVERY MODULES FOR BIFURCATED FUEL TANKS

BACKGROUND

The present invention relates to fuel delivery systems, and more specifically to dual fuel pump delivery systems in bifurcated fuel tanks.

The use of bifurcated fuel tanks, also commonly referred to as saddle tanks, in conjunction with fuel delivery systems having a single fuel pump is known. In such systems, a reservoir surrounds the fuel pump and is constantly filled to ensure that a steady supply of fuel is available to the pump at all times. A jet pump is used to draw fuel through a crossover line from the opposing bifurcated portion of the tank and pump the fuel into the reservoir. The reservoir is usually overflowing and excess fuel fills the bifurcated tank portion housing the fuel pump. This insures that if fuel remains in either of the bifurcated tank portions, it is available to the fuel pump.

Today's high-performance and high-power automobiles require a higher rate of fuel flow to the engine than can often be provided with a single fuel pump. It has become necessary to utilize two fuel pumps, operating in parallel, to provide the necessary fuel delivery to the engine. A bifurcated tank presents an appropriate environment for using dual fuel pump delivery systems as one fuel pump can be housed in each of the two bifurcated tank portions. Since the engine demands fuel flow from both fuel pumps, it is important that both tank portions and both fuel pumps have a sufficient amount of fuel. Due to automobile maneuvering (wherein fuel sloshes over the bifurcating wall of the tank), partial tank filling and variations in fuel pump flow capacities, the fuel levels in the bifurcated portions are often unequal.

SUMMARY

In one embodiment, the invention provides a fuel system for use in a fuel tank having first and second tank portions. The fuel system includes first and second fuel pumps in the first and second tank portions, respectively. A first fuel reservoir is provided in the first tank portion from which the first fuel pump can draw fuel. A second fuel reservoir is provided in the second tank portion from which the second fuel pump can draw fuel. A first crossover fuel line extends between the first and second tank portions, and a second crossover fuel line extends between the first and second tank portions. A first jet pump in the first tank portion communicates with the first crossover fuel line for transferring fuel through the first crossover fuel line to the second tank portion, and a second jet pump in the second tank portion communicates with the second crossover fuel line for transferring fuel through the second crossover fuel line to the first tank portion.

In another embodiment the invention provides a fuel system for use in a fuel tank having first and second tank portions. The fuel system includes first and second fuel pumps in the first and second tank portions, respectively. The first fuel pump has an outlet for supplying fuel to a fuel supply circuit of an engine and the second fuel pump has an outlet for supplying fuel to the fuel supply circuit of the engine. A first fuel reservoir is provided in the first tank portion from which the first fuel pump can draw fuel. A second fuel reservoir is provided in the second tank portion from which the second fuel pump can draw fuel. The fuel system further includes a crossover fuel line extending between the first and second tank portions. A jet pump in the second tank portion communicates with the crossover fuel line for transferring fuel through the crossover fuel line to the second tank portion. A single pressure relief device communicates with the fuel supply circuit and is configured to open above a predetermined pressure to return fuel from the fuel supply circuit to the first fuel reservoir.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
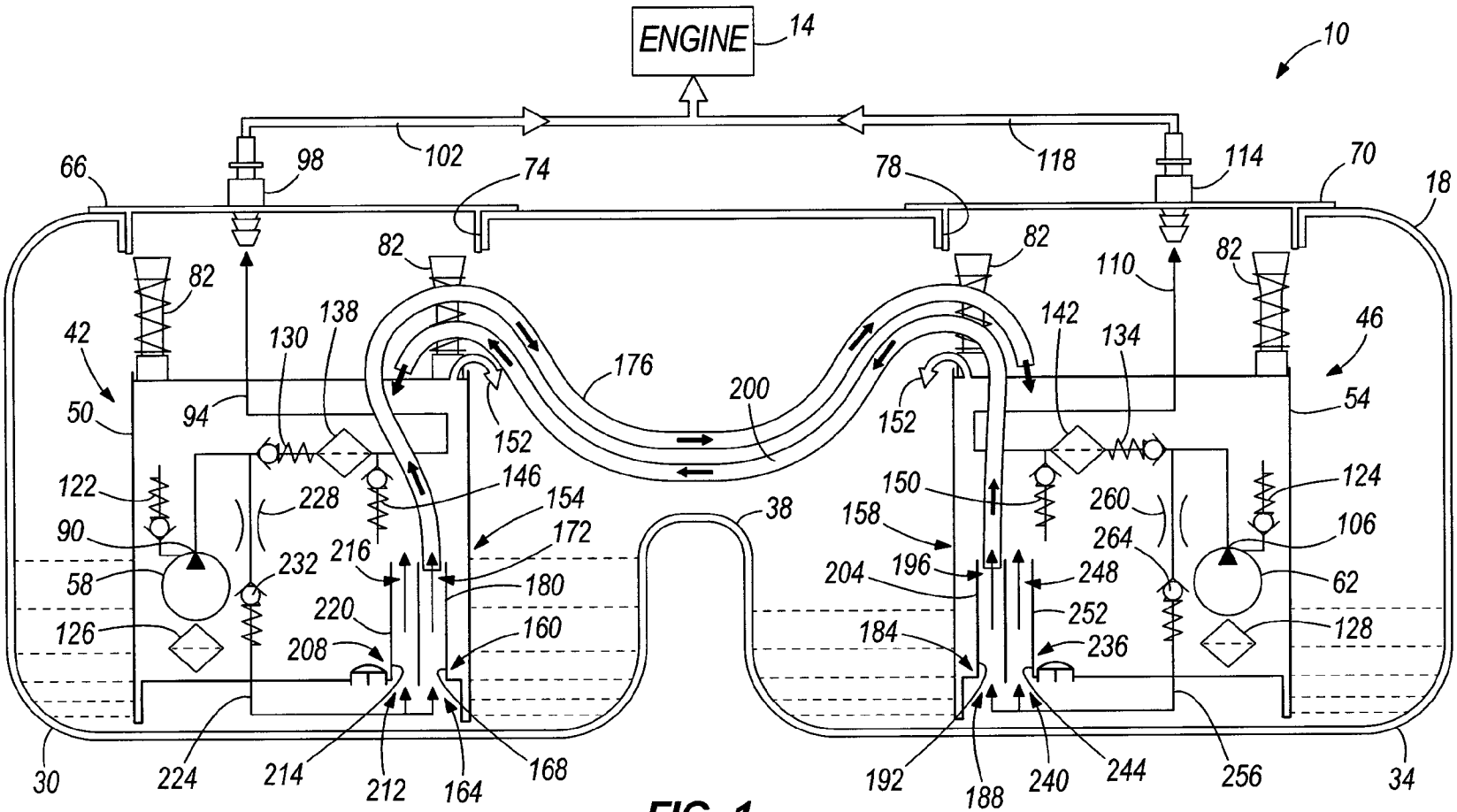
FIG. 1 is a schematic view of a fuel system embodying the invention.

FIG. 1 illustrates a fuel system 10 embodying the present invention. The fuel system 10 is for use in conjunction with an internal combustion engine 14. A bifurcated fuel tank 18, having a first tank portion 30 and a second tank portion 34 is shown in FIG. 1. This type of bifurcated fuel tank is commonly known as a "saddle tank" due to its saddle-like shape. A wall or hump 38 partially separates the first and second tank portions 30 and 34. It is important to note that the tank 18 need not be bifurcated in the manner illustrated, but could be bifurcated in any other way depending upon the packaging constraints of the tank 18 with respect to the vehicle on which it is installed.

The first and second tank portions 30, 34 house respective first and second fuel delivery modules 42, 46 which, in the embodiment shown in FIG. 1, are substantially the same. The first and second fuel delivery modules 42, 46 include respective first and second fuel reservoirs 50, 54, that are at least partially open at the top, and first and second fuel pumps 58, 62 inside the respective reservoirs 50, 54. The fuel delivery modules 42, 46 also include respective first and second closure flanges or covers 66, 70 for closing respective first and second insertion openings 74, 78 of the tank 18. Support assemblies 82 in the form of rods and springs support and separate the respective reservoirs 50, 54 and covers 66, 70 relative to one another.

The fuel pump 58 includes an outlet 90 that communicates with a fuel supply line 94. The fuel supply line 94 communicates between the fuel pump 58 and a port 98 in the first cover 66. An external fuel supply line 102 communicates between the port 98 and the engine 14, such that fuel from the fuel pump 58 travels through the fuel supply line 94, through the port 98, and through the external fuel supply line 102 to the engine 14. Likewise, the fuel pump 62 includes an outlet 106 that communicates with a fuel supply line 110. The fuel supply line 110 communicates between the fuel pump 62 and a port 114 in the second cover 70. An external fuel supply line 118 communicates between the port 114 and the engine 14, such that fuel from the fuel pump 62 travels through the fuel supply line 110, through the port 114, and through the external fuel supply line 118 to the engine 14. Together, the fuel supply lines 94, 110, the ports 98, 114, and the external fuel supply lines 102, 118 define a fuel supply circuit for the engine 14. In an alternative embodiment, the fuel supply lines 94 and 110 could communicate with one another (combining the fuel from both fuel pumps 58, 62) inside the tank 18 such that only a single port in one of the covers 66, 70 would be required to provide fuel from the tank 18 to the engine 14. In such an embodiment, only a single external fuel supply line would extend to the engine 14. The fuel supply circuit would therefore be defined by a different configuration of lines and ports that provide communication between the fuel pumps 58, 62 and the engine 14. Other structural arrangements of the fuel supply circuit are also contemplated.

The fuel pumps 58, 62 can be substantially identical and draw fuel directly from the respective fuel reservoirs 50, 54. This insures that the fuel pumps 58, 62 always have an available supply of fuel during periods of low fuel levels and high vehicle maneuvering. Alternatively, the fuel pumps 58, 62 need not be substantially identical in terms of output flow rate capabilities, but the combined output flow rate of the two pumps 58, 62 should be sufficient to meet engine demand. In other embodiments, the fuel pumps 58, 62 can also selectively draw fuel from the respective tank portions 30, 34 or from the respective reservoirs 50, 54 as is well known in the art.

Each fuel pump 58, 62 includes a respective optional pressure relief valve 122, 124. Additionally, respective fuel filters 126, 128 are provided to filter fuel being drawn into the fuel pumps 58, 62 from the respective fuel reservoirs 50, 54. Furthermore, each fuel line 94, 110 includes a respective check valve 130, 134 for preventing backwards flow of fuel through the fuel pumps 58, 62, a respective fuel filter 138, 142, and a respective pressure relief device 146, 150, that in one embodiment, can operate as bypass pressure regulator to regulate the output of fuel in the fuel lines 94, 110 based on the demand of the engine 14. The first pressure relief device 146 is positioned in the first tank portion 30 (and in the illustrated embodiment, in the first reservoir 50) and can return excess fuel from the first fuel pump 58 to the first reservoir 50 when operating as a bypass pressure regulator. The second pressure relief device 150 is positioned in the second tank portion 34 (and in the illustrated embodiment, in the second reservoir 54) and can return excess fuel from the second fuel pump 62 to the second reservoir 54 when operating as a bypass pressure regulator. In an alternative embodiment, in which fuel pressure is controlled by the voltage supplied to the fuel pumps 58, 62, the pressure relief devices 146 and 150 can operate more like pressure relief valves. In either embodiment, the pressure relief devices 146 and 150 have pressure set points such that when fuel pressure in the fuel supply circuit reaches or exceeds the predetermined pressure set points, the pressure relief devices 146, 150 open, as is understood by those skilled in the art.

Since the engine 14 requires fuel flow from both fuel pumps 58, 62 when engine fuel demand is high, fuel is constantly supplied to the reservoirs 50, 54 as will be described below. The constant supply of fuel means the reservoirs 50, 54 are substantially always full and overflowing (as represented by arrows 152) into the respective tank portions 30, 34 during normal operation with a sufficient amount of fuel.

First and second fuel transfer units 154, 158 are provided to transfer fuel from one tank portion 30, 34 to the fuel reservoir 50, 54 in the opposite tank portion 30, 34. The first fuel transfer unit 154 includes a first jet pump 160 positioned in the first reservoir 50. The first jet pump 160 has an inlet 164 communicating through an aperture 168 in the first reservoir 50 with the fuel in the first tank portion 30. The first jet pump 160 further includes a first outlet 172 that communicates with a first crossover fuel line 176 for transferring fuel from the first tank portion 30 to the second tank portion 34, and more specifically to the second reservoir 54 in the second tank portion 34. The first outlet 172 can be formed in a stand pipe 180, with the first crossover fuel line 176 coupled to the first outlet 172 (i.e., to the outlet end of the stand pipe 180) within the first reservoir 50. The first crossover fuel line 176 extends from the first outlet 172, out of the first reservoir 50, across the wall 38 of the saddle tank 18, and into the second tank portion 34 to expel transferred fuel into the second reservoir 54. The outlet end of the first crossover fuel line 176 can be positioned above the second reservoir 54 or can extend into the second reservoir 54.

The second fuel transfer unit 158 includes a second jet pump 184 positioned in the second reservoir 54. The second jet pump 184 has an inlet 188 communicating through an aperture 192 in the second reservoir 54 with the fuel in the second tank portion 34. The second jet pump 184 further includes a first outlet 196 that communicates with a second crossover fuel line 200 for transferring fuel from the second tank portion 34 to the first tank portion 30, and more specifically to the first reservoir 50 in the first tank portion 30. The first outlet 196 can be formed in a stand pipe 204, with the second crossover fuel line 200 coupled to the first outlet 196 (i.e., to the outlet end of the stand pipe 204) within the second reservoir 54. The second crossover fuel line 200 extends from the first outlet 196, out of the second reservoir 54, across the wall 38 of the saddle tank 18, and into the first tank portion 30 to expel transferred fuel into the first reservoir 50. The outlet end of the second crossover fuel line 200 can be positioned above the first reservoir 50 or can extend into the first reservoir 50.

The fuel system 10 further includes a third jet pump 208 positioned in the first reservoir 50. The third jet pump 208 has an inlet 212 communicating through an aperture 214 in the first reservoir 50 with the fuel in the first tank portion 30, and an outlet 216 communicating with the first fuel reservoir 50. The outlet 216 can be coupled with a stand pipe 220 that extends upwardly in the first fuel reservoir 50. In the illustrated embodiment, the first jet pump 160 and the third jet pump 208 are both powered by fuel diverted from the outlet 90 of the fuel pump 58 via a diverting line 224. The diverting line 224 includes an optional throttle 228 and an optional check valve 232 that prevents backward flow of fuel in the diverting line 224 toward the outlet 90. In other embodiments, the jet pumps 160 and 208 can be powered by the fuel pump 58 in an alternative manner, such as via a line from a secondary outlet of the fuel pump 58. Such a line need not include a throttle or a check valve. The high pressure fuel in the diverting line 224 enters the first jet pump 160, and due to the Venturi effect, causes fuel in the first tank portion 30 to be drawn into the first jet pump 160 through the inlet 164. This fuel being drawn into the inlet 164 from the first tank portion 30 mixes with the high pressure fuel powering the jet pump 160 and exits the jet pump 160 through the outlet 172. Fuel exiting through the outlet 172 of the first jet pump 160 is transferred (i.e., is pushed or driven by the jet pump 160) to the second reservoir 54 via the first crossover fuel line 176. A portion of the high pressure fuel in the diverting line 224 also enters the third jet pump 208, and due to the Venturi effect, causes fuel in the first tank portion 30 to be drawn into the third jet pump 208 through the inlet 212. Fuel exiting through the outlet 216 of the third jet pump 208 fills the first reservoir 50.

The fuel system 10 further includes a fourth jet pump 236 positioned in the second reservoir 54. The fourth jet pump 236 has an inlet 240 communicating through an aperture 244 in the second reservoir 54 with the fuel in the second tank portion 34, and an outlet 248 communicating with the second fuel reservoir 54. The outlet 248 can be coupled with a stand pipe 252 that extends upwardly in the second fuel reservoir 54. In the illustrated embodiment, the second jet pump 184 and the fourth jet pump 236 are both powered by fuel diverted from the outlet 106 of the fuel pump 62 via a diverting line 256. The diverting line 256 includes an optional throttle 260 and an optional check valve 264 that prevents backward flow of fuel in the diverting line 256 toward the outlet 106. In other embodiments, the jet pumps 184 and 236 can be powered by the fuel pump 62 in an alternative manner, such as via a line from a secondary outlet of the fuel pump 62. Such a line need not include a throttle or a check valve. The high pressure fuel in the diverting line 256 enters the second jet pump 184, and due to the Venturi effect, causes fuel in the second tank portion 34 to be drawn into the second jet pump 184 through the inlet 188. This fuel being drawn into the inlet 188 from the second tank portion 34 mixes with the high pressure fuel powering the jet pump 184 and exits the jet pump 184 through the outlet 196. Fuel exiting through the outlet 196 of the second jet pump 184 is transferred (i.e., is pushed or driven by the jet pump 184) to the first reservoir 50 via the second crossover fuel line 200. A portion of the high pressure fuel in the diverting line 256 also enters the fourth jet pump 236, and due to the Venturi effect, causes fuel in the second tank portion 34 to be drawn into the fourth jet pump 236 through the inlet 240. Fuel exiting through the outlet 248 of the fourth jet pump 236 fills the second reservoir 54.

With this system, the first and fourth jet pumps 160, 236 both operate to fill the second reservoir 54. The first jet pump 160 transfers fuel from the first tank portion 30, across the first fuel crossover line 176, to the second reservoir 54, while the fourth jet pump 236 transfers fuel from the second tank portion 34 into the second reservoir 54. Likewise, the second and third jet pumps 208, 184 both operate to fill the first reservoir 50. The second jet pump 184 transfers fuel from the second tank portion 34, across the second fuel crossover line 200, to the first reservoir 50, while the third jet pump transfers fuel from the first tank portion 30 into the first reservoir 50. Should one of the tank portions 30, 34 become empty, the jet pump in the opposing tank portion will continue to fill the reservoir in the empty tank portion to ensure that the associated fuel pump has a sufficient supply of fuel.

The jet pumps 160, 184, 208, and 236 can be configured as shown and described in U.S. Pat. No. 6,457,945 assigned to Robert Bosch GmbH, the entire content of which is hereby incorporated by reference. The combined flow capacity of the first and second jet pumps 160, 184 should be greater than the maximum engine fuel requirements. However, the flow capacities of the first and second jet pumps 160, 184 need not be balanced (i.e., need not be substantially equal) in this fuel system 10. By not requiring balanced flow capacities for the first and second jet pumps 160, 184, the fuel system 10 can be easier to both design and manufacture.

Figure 2:
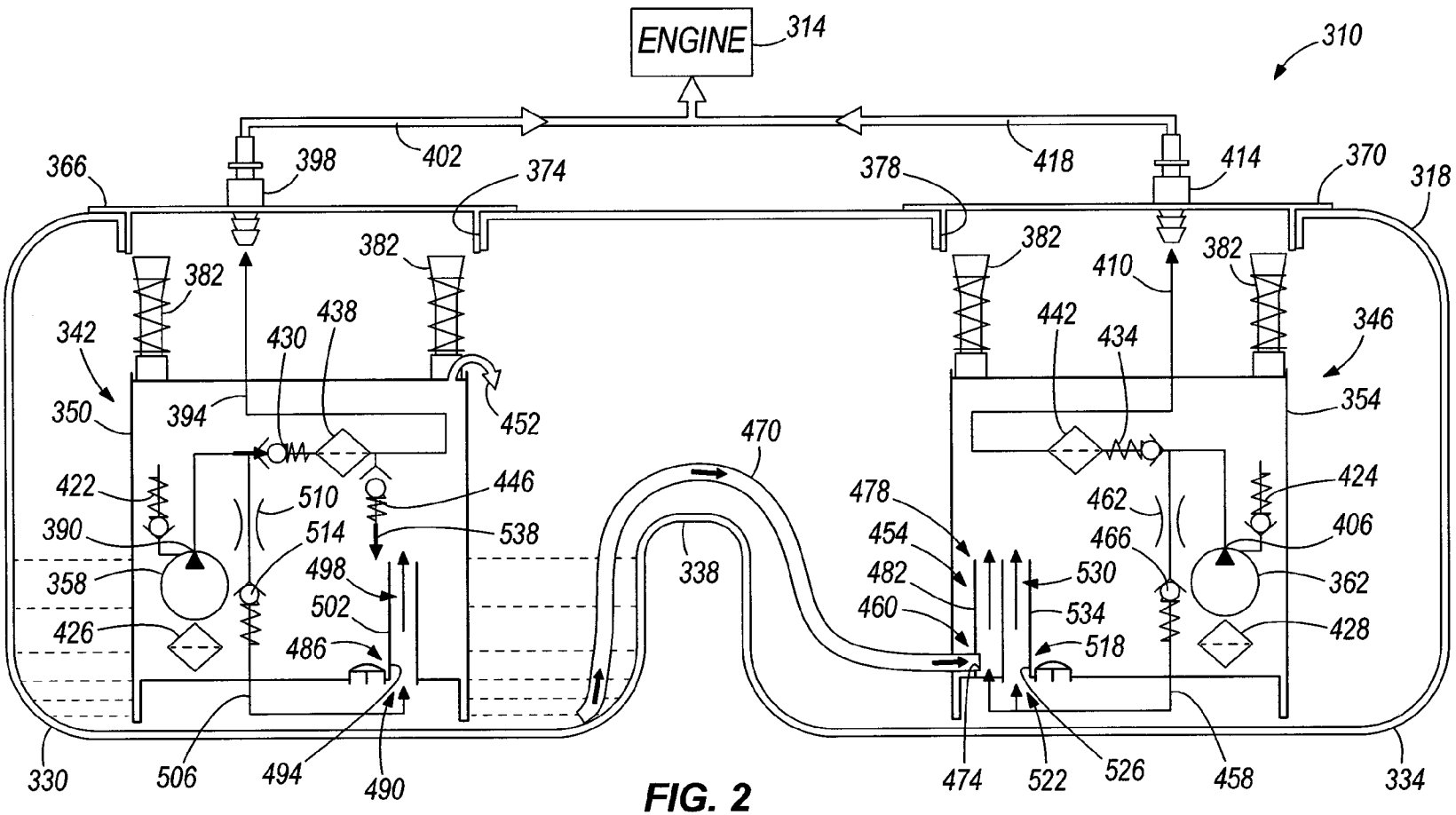
FIG. 2 is a schematic view of another fuel system embodying the invention.

FIG. 2 illustrates a second embodiment of a fuel system 310 of the present invention. The fuel system 310 is for use in conjunction with an internal combustion engine 314. A bifurcated fuel tank 318, having a first tank portion 330 and a second tank portion 334 is shown in FIG. 2. This type of bifurcated fuel tank is commonly known as a "saddle tank" due to its saddle-like shape. A wall or hump 338 partially separates the first and second tank portions 330 and 334. It is important to note that the tank 318 need not be bifurcated in the manner illustrated, but could be bifurcated in any other way depending upon the packaging constraints of the tank 318 with respect to the vehicle on which it is installed.

The first and second tank portions 330, 334 house respective first and second fuel delivery modules 342, 346 which, in the embodiment shown in FIG. 2, are not the same. The first and second fuel delivery modules 342, 346 include respective first and second fuel reservoirs 350, 354, that are at least partially open at the top, and first and second fuel pumps 358, 362 inside the respective reservoirs 350, 354. The fuel delivery modules 342, 346 also include respective first and second closure flanges or covers 366, 370 for closing respective first and second insertion openings 374, 378 of the tank 318. Support assemblies 382 in the form of rods and springs support and separate the respective reservoirs 350, 354 and covers 366, 370 relative to one another.

The fuel pump 358 includes an outlet 390 that communicates with a fuel supply line 394. The fuel supply line 394 communicates between the fuel pump 358 and a port 398 in the first cover 366. An external fuel supply line 402 communicates between the port 398 and the engine 314, such that fuel from the fuel pump 358 travels through the fuel supply line 394, through the port 398, and through the external fuel supply line 402 to the engine 314. Likewise, the fuel pump 362 includes an outlet 406 that communicates with a fuel supply line 410. The fuel supply line 410 communicates between the fuel pump 362 and a port 414 in the second cover 370. An external fuel supply line 418 communicates between the port 414 and the engine 314, such that fuel from the fuel pump 362 travels through the fuel supply line 410, through the port 414, and through the external fuel supply line 418 to the engine 314. Together, the fuel supply lines 394, 410, the ports 398, 414, and the external fuel supply lines 402, 418 define a fuel supply circuit for the engine 314. In an alternative embodiment, the fuel supply lines 394 and 410 could communicate with one another (combining the fuel from both fuel pumps 358, 362) inside the tank 318 such that only a single port in one of the covers 366, 370 would be required to provide fuel from the tank 318 to the engine 314. In such an embodiment, only a single external fuel supply line would extend to the engine 314. The fuel supply circuit would therefore be defined by a different configuration of lines and ports that provide communication between the fuel pumps 358, 362 and the engine 314. Other structural arrangements of the fuel supply circuit are also contemplated.

The fuel pumps 358, 362 can be substantially identical and draw fuel directly from the respective fuel reservoirs 350, 354. This insures that the fuel pumps 358, 362 always have an available supply of fuel during periods of low fuel levels and high vehicle maneuvering. Alternatively, the fuel pump 358 can be larger (in terms of output flow rate capabilities) than the fuel pump 362, but the combined output flow rate of the two pumps 358, 362 should be sufficient to meet engine demand. In other embodiments, the fuel pumps 358, 362 can also selectively draw fuel from the respective tank portions 330, 334 or from the respective reservoirs 350, 354 as is well known in the art.

Each fuel pump 358, 362 includes a respective optional pressure relief valve 422, 424. Additionally, respective fuel filters 426, 428 are provided to filter fuel being drawn into the fuel pumps 358, 362 from the respective fuel reservoirs 350, 354. Furthermore, each fuel line 394, 410 includes a respective check valve 430, 434 for preventing backwards flow of fuel through the fuel pumps 358, 362, and a respective fuel filter 438, 442. The first fuel pump module 342 includes a pressure relief device in the form of a bypass pressure regulator 446 to regulate the output of fuel in the fuel line 394 and in the entire fuel supply circuit based on demand of the engine 314. The bypass pressure regulator 446 is positioned in the first tank portion 330 (and in the illustrated embodiment, in the first reservoir 350) and returns excess fuel from the fuel supply circuit to the first reservoir 350 as will be described further below. There is no second or corresponding pressure relief device in the fuel system 310, which is clear from the absence of any bypass pressure regulator in the second fuel reservoir 354.

Since the engine 314 requires fuel flow from both fuel pumps 358, 362 when engine fuel demand is high, fuel is constantly supplied to the reservoirs 350, 354 as will be described below. As will be discussed further, as long as there is sufficient amount of fuel in the tank 318, the first reservoir 350 is substantially always full and overflowing (as represented by arrow 452) into the first tank portion 330 during normal operation.

The fuel system 310 includes a single fuel transfer unit 454 to transfer fuel from the first tank portion 330 to the second fuel reservoir 354. The fuel transfer unit 454 includes a first jet pump 460 positioned in the second reservoir 354. In the illustrated embodiment, the first jet pump 460 is powered by fuel diverted from the outlet 406 of the fuel pump 362 via a diverting line 458. The diverting line 458 includes an optional throttle 462 and an optional check valve 466 that prevents backward flow of fuel in the diverting line 458 toward the outlet 406. In other embodiments, the jet pump 460 can be powered by the fuel pump 362 in an alternative manner, such as via a line from a secondary outlet of the fuel pump 362. Such a line need not include a throttle or a check valve. The high pressure fuel in the diverting line 458 enters the first jet pump 460, and due to the Venturi effect, causes fuel in the first tank portion 330 to be drawn into the first jet pump 460 through a crossover fuel line 470 that extends across the wall 338 of the saddle tank 318 between the first and second tank portions 330, 334. The crossover fuel line 470 has a first end positioned in the first tank portion 330 to draw fuel directly from the first tank portion 330. The first end of the crossover fuel line 470 can communicate directly with the fuel in the first reservoir 350, or can be positioned as shown in FIG. 2 outside the first reservoir 350. The second end of the crossover fuel line 470 communicates with an inlet 474 of the first jet pump 460. This fuel being drawn into the inlet 474 through the crossover fuel line 470 from the first tank portion 330 mixes with the high pressure fuel powering the first jet pump 460 and exits the first jet pump 460 through an outlet 478. The outlet 478 can be coupled with a stand pipe 482 that extends upwardly in the second fuel reservoir 354. Fuel exiting through the outlet 478 of the first jet pump 460 is therefore transferred (i.e., is pulled by the first jet pump 460) from the first tank portion 330 to the second fuel reservoir 350 via the crossover fuel line 470.

The fuel system 310 further includes a second jet pump 486 positioned in the first reservoir 350. The second jet pump 486 has an inlet 490 communicating through an aperture 494 in the first reservoir 350 with the fuel in the first tank portion 330, and an outlet 498 communicating with the first fuel reservoir 350. The outlet 498 can be coupled with a stand pipe 502 that extends upwardly in the first fuel reservoir 350. In the illustrated embodiment, the second jet pump 486 is powered by fuel diverted from the outlet 390 of the fuel pump 358 via a diverting line 506. The diverting line 506 includes an optional throttle 510 and an optional check valve 514 that prevents backward flow of fuel in the diverting line 506 toward the outlet 390. In other embodiments, the jet pump 486 can be powered by the fuel pump 358 in an alternative manner, such as via a line from a secondary outlet of the fuel pump 358. Such a line need not include a throttle or a check valve. The high pressure fuel in the diverting line 506 enters the second jet pump 486, and due to the Venturi effect, causes fuel in the first tank portion 330 to be drawn into the second jet pump 486 through the inlet 490. This fuel being drawn into the inlet 490 from the first tank portion 330 mixes with the high pressure fuel powering the jet pump 486 and exits the jet pump 486 through the outlet 498. Fuel exiting through the outlet 498 of the second jet pump 486 fills the first reservoir 350.

The fuel system 310 further includes a third jet pump 518 positioned in the second reservoir 354. The third jet pump 518 has an inlet 522 communicating through an aperture 526 in the second reservoir 354 with the fuel in the second tank portion 334, and an outlet 530 communicating with the second fuel reservoir 354. The outlet 530 can be coupled with a stand pipe 534 that extends upwardly in the second fuel reservoir 354. In the illustrated embodiment, the third jet pump 518, like the first jet pump 460, is powered by fuel diverted from the outlet 406 of the fuel pump 362 via the diverting line 458. In other embodiments, the jet pump 460 can be powered by the fuel pump 362 in an alternative manner, such as via a line from a secondary outlet of the fuel pump 362. Such a line need not include a throttle or a check valve. A portion of the high pressure fuel in the diverting line 458 also enters the third jet pump 518, and due to the Venturi effect, causes fuel in the second tank portion 334 to be drawn into the third jet pump 518 through the inlet 522. Fuel exiting through the outlet 530 of the third jet pump 518 fills the second reservoir 354. The jet pumps 460, 486, and 518 can be configured as shown and described in U.S. Pat. No. 6,457,945 assigned to Robert Bosch GmbH, the entire content of which is hereby incorporated by reference.

With this system, the first and third jet pumps 460, 518 both operate to fill the second reservoir 354. The first jet pump 460 transfers fuel from the first tank portion 330, across the first fuel crossover line 470, to the second reservoir 354, while the third jet pump transfers fuel from the second tank portion 334 into the second reservoir 354. The second jet pump 486 operates to fill the first reservoir 350.

The first fuel pump 358 and the second fuel pump 362 pump fuel from their respective reservoirs 350, 354 into the fuel supply circuit, as described above. Due to the absence of any bypass pressure regulator in the fuel line 410, fuel pumped by the second fuel pump 362 and not diverted via diverting line 458 will travel through the port 414 and the external fuel line 418 to the engine 314. Any excess fuel provided to the fuel supply circuit by the second fuel pump 362 that will not be consumed by the engine 314 cannot be returned to the second reservoir 354, and will cause the fuel pressure in the fuel supply circuit to increase. The bypass pressure regulator 446 opens when pressure in fuel circuit reaches or exceeds the predetermined pressure regulator set point, causing the excess fuel provided by the second fuel pump 362 to flow through the external fuel line 402 and the port 398 into the first fuel pump module 342, through the fuel line 394, into the first reservoir 350, and through the pressure regulator 446 in the first reservoir 350 (as indicated by the arrow 538—effectively reversing the normal flow direction in each of the external fuel line 402 and the fuel line 394 to the pressure regulator 446). This might occur at the idle condition or other low fuel consumption conditions. At the same time during such low fuel consumption conditions, fuel being supplied to the fuel supply circuit by the first fuel pump 358 will also return to the first reservoir 350 via the bypass pressure regulator 446 (as indicated by the arrow 538). With this configuration, fuel from the second reservoir 354 is essentially transferred (i.e., is pushed by the second fuel pump 362) from the second reservoir 354 to the first reservoir 350 through the fuel supply circuit during periods of low engine fuel consumption.

In the illustrated embodiment, the second fuel pump 362 can be sized (in terms of output flow capacity) to have a smaller output than the first fuel pump 358 so that in all but perhaps idle or other very low fuel requirement conditions, all of the fuel output by the second fuel pump 362 that is not diverted through diverting line 458 is used by the engine 314. The output flow rate of the second fuel pump 362 is also greater than the flow rate of the first jet pump 460, meaning that when the second tank portion 334 is empty and no fuel is being provided to the second reservoir 354 by the third jet pump 518, the second fuel pump 362 will be capable of emptying the second reservoir 354 of fuel faster than the first jet pump 460 can, on its own, fill the second reservoir 354. This may result in some cavitation of the second fuel pump 362, however, there is a sufficient amount of fuel in the second reservoir 354 to prevent the second fuel pump 362 from overheating or burning out. With this arrangement, the fuel system 310 is designed such that as the fuel level diminishes to a level below the wall 338, the system is biased so that the first reservoir 350 remains full while the second reservoir 354 will quickly become and remain substantially empty.

The fuel system 310 also provides another advantage in that it can be operated so that the second fuel pump 362 can be selectively turned off when engine demand permits and when no fuel transfer from the second tank portion 334 to the first tank portion 330 is needed. For example, when engine demand is low and can be met by the flow from the first fuel pump 358 alone, the second fuel pump 362 can be turned off. By turning off the second fuel pump 362, the electrical power savings can result in increased fuel mileage for the vehicle. Fuel level sensors in each tank portion 330, 334 can monitor the fuel levels in each tank portion 330, 334 when the overall fuel level is below the wall 338. Should the fuel level in the first tank portion 330 get low (relative to the fuel level in the second tank portion 334), the second fuel pump 362 can be turned on so that fuel transfer can occur from the second tank portion 334 to the first tank portion 330 as described above. Once the fuel level in the first tank portion 330 reaches a sufficient level, the second fuel pump 362 can again be turned off if engine fuel demand permits.

Various features and advantages of the invention are set forth in the following claims.

What is claimed is:

1. A fuel system for use in a fuel tank having first and second tank portions, the fuel system comprising:

first and second fuel pumps in the first and second tank portions, respectively, the first fuel pump having an outlet for supplying fuel to a fuel supply circuit of an engine and the second fuel pump having an outlet for supplying fuel to the fuel supply circuit of the engine;

a first fuel reservoir in the first tank portion from which the first fuel pump can draw fuel; and a second fuel reservoir in the second tank portion from which the second fuel pump can draw fuel;

a crossover fuel line extending between the first and second tank portions;

a jet pump in the second tank portion communicating with the crossover fuel line for transferring fuel from the first tank portion, through the crossover fuel line to the second tank portion, the jet pump being the only jet pump communicating with the crossover fuel line; and a single pressure relief device communicating with the fuel supply circuit and configured to open above a predetermined pressure to return fuel from the second tank portion to the first fuel reservoir.

2. The fuel system of claim 1, wherein at least a portion of the crossover fuel line is positioned in the second fuel reservoir.

3. The fuel system of claim 1, wherein the single pressure relief device is positioned in the first fuel reservoir.

4. The fuel system of claim 1, wherein the jet pump is positioned in the second fuel reservoir.

5. The fuel system of claim 4, wherein the jet pump includes an inlet communicating with the crossover fuel line and an outlet communicating with the second fuel reservoir.

6. The fuel system of claim 5, wherein the jet pump transfers fuel from the first tank portion, through the crossover fuel line, and into the second fuel reservoir.

7. The fuel system of claim 6, wherein the jet pump is a first jet pump and wherein the fuel system further comprises a second jet pump in the first fuel reservoir.

8. The fuel system of claim 7, wherein the second jet pump includes an inlet communicating with the first tank portion and an outlet communicating with the first fuel reservoir so that the second jet pump transfers fuel from the first tank portion into the first fuel reservoir.

9. The fuel system of claim 8, further comprising a third jet pump in the second fuel reservoir, the third jet pump having an inlet communicating with the second tank portion and an outlet communicating with the second fuel reservoir so that the third jet pump transfers fuel from the second tank portion into the second fuel reservoir.

10. The fuel system of claim 9, wherein the first and third jet pumps are powered by fuel from the second fuel pump, and wherein the second jet pump is powered by fuel from the first fuel pump.

11. The fuel system of claim 9, wherein the second fuel pump has a flow rate greater than a flow rate of the first jet pump.

12. The fuel system of claim 1, wherein the jet pump is powered by fuel from the second fuel pump.

13. The fuel system of claim 1, wherein the second fuel pump has a flow rate greater than a flow rate of the jet pump.

14. The fuel system of claim 1, wherein the single pressure relief device is a bypass pressure regulator disposed in the first fuel reservoir.

15. The fuel system of claim 1, wherein the second fuel reservoir does not include a bypass pressure regulator.

16. The fuel system of claim 1, wherein the crossover fuel line includes an end disposed in the first tank portion that communicates directly with fuel in the first tank portion.

17. The fuel system of claim 1, wherein the jet pump is configured to pull fuel from the first tank portion into the second fuel reservoir.

18. The fuel system of claim 1, wherein the crossover fuel line directs fuel only in a single direction.

19. A fuel system for use in a fuel tank having first and second tank portions, the fuel system comprising:

first and second fuel pumps in the first and second tank portions, respectively, the first fuel pump having an outlet for supplying fuel to a fuel supply circuit of an engine and the second fuel pump having an outlet for supplying fuel to the fuel supply circuit of the engine;

a first fuel reservoir in the first tank portion from which the first fuel pump can draw fuel;

a second fuel reservoir in the second tank portion from which the second fuel pump can draw fuel;

a crossover fuel line extending between the first and second tank portions, the crossover fuel line being the only crossover fuel line between the first and second tank portions;

a jet pump in the second tank portion communicating with the crossover fuel line for transferring fuel from the first tank portion, through the crossover fuel line to the second tank portion, the jet pump being the only jet pump communicating with the crossover fuel line; and a single pressure relief device communicating with the fuel supply circuit and configured to open above a predetermined pressure to return fuel from the fuel supply circuit to the first fuel reservoir.

* * * * *